US009027456B2

(12) United States Patent
Mhaskar

(10) Patent No.: US 9,027,456 B2
(45) Date of Patent: May 12, 2015

(54) MULTI-LAYERED PERFORATING GUN USING EXPANDABLE TUBULARS

(75) Inventor: Nauman H. Mhaskar, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 383 days.

(21) Appl. No.: 13/173,393

(22) Filed: Jun. 30, 2011

(65) Prior Publication Data

US 2013/0000472 A1 Jan. 3, 2013

(51) Int. Cl.
*E21B 43/117* (2006.01)

(52) U.S. Cl.
CPC ..... *E21B 43/117* (2013.01)

(58) Field of Classification Search
USPC ..... 89/1.151, 1.15; 102/323, 324, 316, 329, 102/309; 166/297, 55; 175/4.54; 138/114, 138/143; 29/507; 72/370.08, 421.1
See application file for complete search history.

(56) References Cited

U.S. PATENT DOCUMENTS

| | | | | |
|---|---|---|---|---|
| 171,440 | A * | 12/1875 | Smith | 285/55 |
| 1,823,847 | A * | 9/1931 | Gerhard et al. | 536/66 |
| 3,116,690 | A * | 1/1964 | Gillingham et al. | 175/4.54 |
| 4,359,811 | A * | 11/1982 | Monroe | 29/421.1 |
| 4,377,894 | A * | 3/1983 | Yoshida | 29/421.1 |
| 4,449,281 | A * | 5/1984 | Yoshida et al. | 29/421.1 |
| 4,534,423 | A * | 8/1985 | Regalbuto | 175/4.6 |
| 6,865,978 | B2 | 3/2005 | Kash | |
| 7,055,421 | B2 * | 6/2006 | Kash | 89/1.15 |
| 7,246,548 | B2 * | 7/2007 | Kash | 89/1.15 |
| 7,546,754 | B2 * | 6/2009 | Yang | 72/61 |
| 8,281,476 | B2 * | 10/2012 | Hur et al. | 29/523 |
| 2002/0069784 | A1 | 6/2002 | Landman et al. | |
| 2004/0211565 | A1 * | 10/2004 | Kash | 166/297 |
| 2005/0217842 | A1 | 10/2005 | Kash | |
| 2008/0011483 | A1 | 1/2008 | LaGrange et al. | |

OTHER PUBLICATIONS

Andrei Filippov et al., "Expandable Tubular Solutions"; Society of Petroleum Engineers, SPE Paper No. 56500, Oct. 1999.

International Search Report and Written Opinion; International Application No. PCT/US2012/042242; International Filing Date: Jun. 13, 2012; Date of Mailing Jan. 30, 2013; 12 pages.

* cited by examiner

*Primary Examiner* — Reginald Tillman, Jr.
(74) *Attorney, Agent, or Firm* — Cantor Colburn LLP

(57) ABSTRACT

A perforating gun body including a first layer having a first yield strength and a second layer having a second yield strength, the second layer positioned radially inwardly from the first layer with a radial gap initially provided between the first and second layers, the second layer expanded radially to engage the first and second layers, the first and second yield strengths being dissimilar.

11 Claims, 2 Drawing Sheets

MULTI-LAYERED PERFORATING GUN USING EXPANDABLE TUBULARS

BACKGROUND

Perforating guns are used in the downhole drilling and completions industry for creating holes in casings, cement, formation walls, etc., with shaped charges. The bodies of the perforating guns (carriers) are subject to excessive swelling and failure from cracks that form and propagate due to the high forces created by setting off charges within the bodies, which limits the amount of explosives that can be used. Fracture or splitting of a perforating gun body can result in an expensive fishing operation and lost rig time. As a result, the industry is always desirous of advancements to improve ballistic survival characteristics of perforating gun bodies.

BRIEF DESCRIPTION

A perforating gun body including a first layer having a first yield strength and a second layer having a second yield strength, the second layer positioned radially inwardly from the first layer with a radial gap initially provided between the first and second layers, the second layer expanded radially to engage the first and second layers, the first and second yield strengths being dissimilar.

A perforating gun body including a first layer, and a second layer located radially inward from the first layer, the second layer expanded for engaging the first and second layers, one of the first layer or the second layer having a plurality of holes radially therethrough prior to expanding the second layer.

A method of forming a perforating gun including positioning a first layer having a first yield strength radially outwardly from a second layer having a second yield strength, a radial gap initially formed between the first and second layers, the first and second yield strengths being dissimilar, and expanding the second layer radially outwardly for engaging the first and second layers together.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
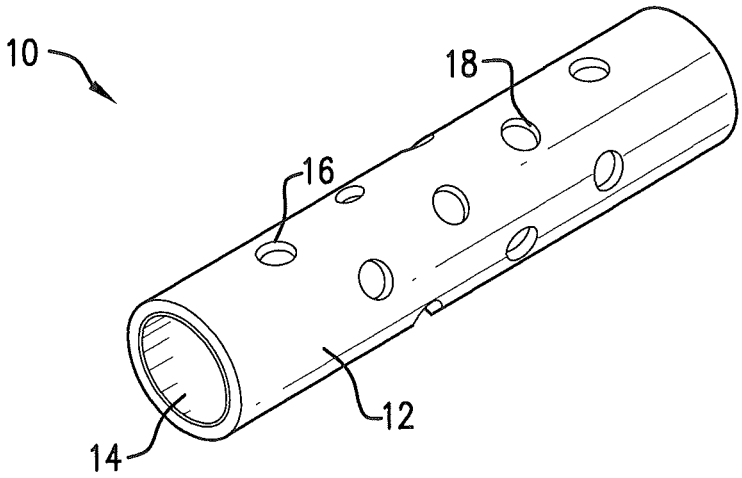
FIG. 1 is a perspective view of a perforating gun body.

Referring now to FIG. 1, a perforating gun body 10 is shown having an outer layer 12 and an inner layer 14. The outer layer 12 has a plurality of holes 16 extending radially therethrough while the inner layer 14 is continuous throughout. In combination with the continuous inner layer 14, the holes 16 in the outer layer 12 create a plurality of scallops 18 for assisting in the usage of shaped explosive charges. For example, the scallops 18 are aligned with the phasing of the perforating gun's explosive charges for facilitating creation of perforations of desired diameter and depth.

Figure 2:
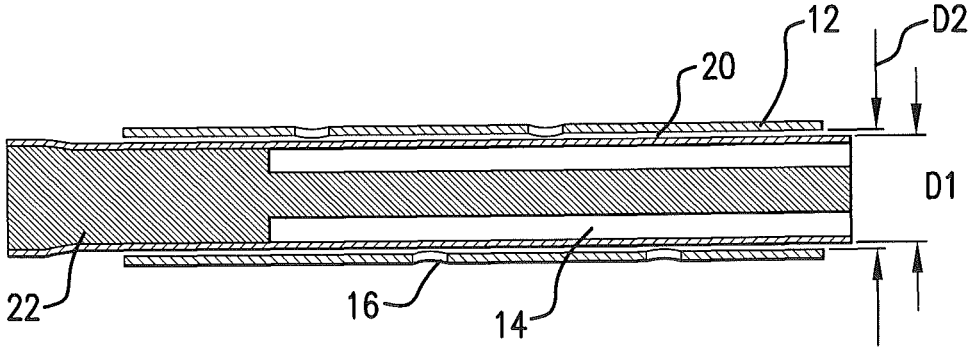
FIG. 2 is a cross-sectional view of a perforating gun body with an inner layer being radially expanded by a mandrel.
Figure 3:
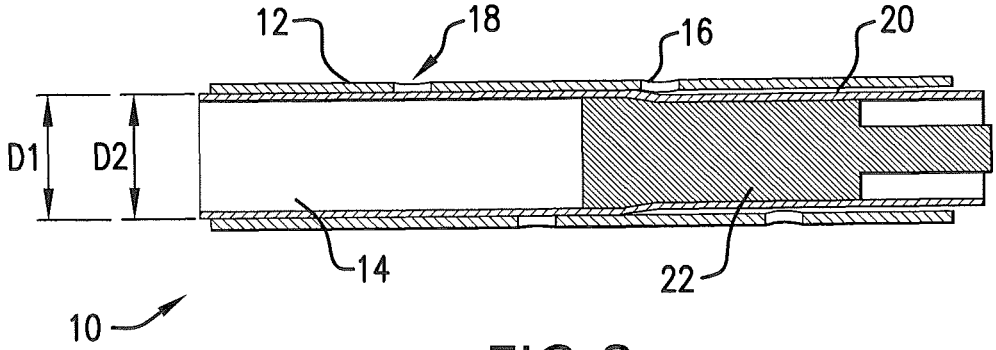
FIG. 3 is a cross-sectional view of a the perforating gun body of FIG. 2 after the mandrel has expanded a length of the inner layer.

A process of forming the gun body 10 can be appreciated in view of FIGS. 2-3. First, the outer layer 12 is provided with the holes 16, via any known means, such as a punch, drill, laser, etc. Then, the inner layer 14 is positioned radially within the outer layer 12. The outer layer has an inner dimension D1 that is larger than an outer dimension D2 of the inner layer 14, thereby initially resulting in a radial gap 20 between the inner layer 14 and the outer layer 12. A tapered mandrel 22 is then run axially through the interior of the inner tube 14. The mandrel 22 is wider than the radial space inside the inner layer 14, resulting in the mandrel radially expanding the inner layer 14 outwardly until the outer diameter D2 of the inner layer 14 about equals the inner diameter D1 of the outer layer 12. Alternatively stated, the mandrel 22 is arranged to expand the inner layer 14 until the inner and outer layers engage. The mandrel 22 could be actuated by a pressure differential, a pulling force, a pushing force, etc.

Figure 4:
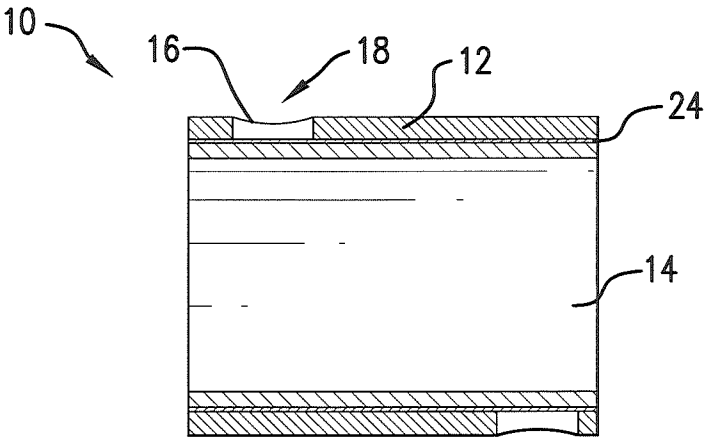
FIG. 4 is a cross-sectional view of a perforating gun body including a coating for sealing inner and outer layers of the gun body.

In the embodiment of FIG. 4, a coating 24 is provided between the first and second layers 12 and 14 so that the inner and outer layers 12 and 14 are sealed in a fluid tight manner. For example, the interface between the layers 12 and 14 at the scallops 18 could enable fluid to travel between the layers 12 and 14, which could adversely affect the performance of the gun. The coating 24 could be an elastomeric coating, high temperature grease, silicone putty, metallic adhesives, etc. Even though the coating 24 may be provided between the layers and the layers may therefore not physically touch due to the coating 24, the layers are still considered as having been engaged because the layers are generally supported radially against each other.

Figure 5:
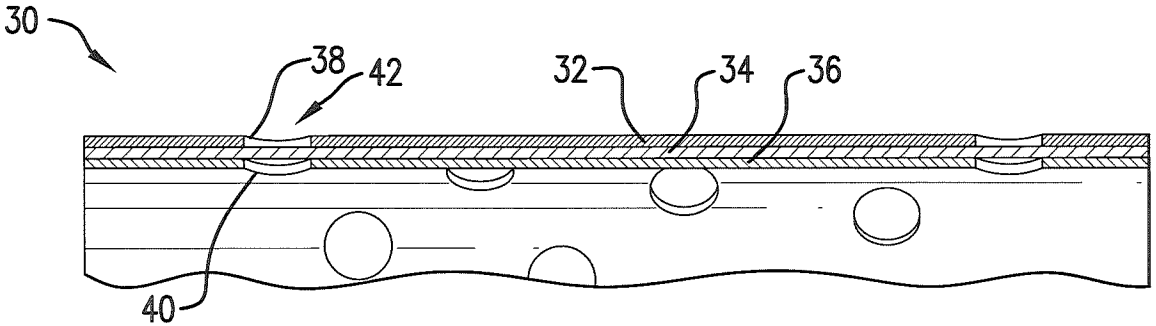
FIG. 5 is a cross-sectional view of a perforating gun body having three layers.

It is to be appreciated that multiple layers could be expanded radially with a plurality of appropriately sized mandrels in order to create a gun body with more than two layers. For example, FIG. 5 shows a gun body 30 according to another embodiment including three layers, namely, outer layer 32, middle layer 34, and inner layer 36. In this embodiment, the middle layer 34 would be expanded via a mandrel in the outer layer 32, then the inner layer 32 would be expanded in the middle layer 34. In this way, a gun body could include any number of layers. The outer layer 32 has a plurality of holes 38 therethrough while the inner layer 36 has a plurality of holes 40 therethrough. The plurality of holes 38 are aligned with the plurality of holes 40 for forming a plurality of double-sided scallops 42, which scallops 42 are aligned with the phasing of the shaped charges used in the gun body 30. Of course, the holes 38 and 40 can be formed by any known means before the layers are expanded for ease of manufacture.

In any embodiment, a layer or layers may have a higher yield strength than another layer or layers. In one embodiment, two layers are used and the yield strength of the inner layer is about 175 kpsi, while the yield strength of the outer layer is about 130 kpsi. In one embodiment, several layers are utilized with the innermost and outermost layers having a relatively lower yield strength (e.g., 130 kpsi) and an intermediate or middle layer having a higher yield strength (e.g., 175 kpsi). Advantageously, these arrangements will have an increased pressure rating by incorporating the high strength layer(s), while the more ductile layer(s) react favorably to explosion shockwaves and shaped charge shrapnel impacts, and also help prevent undue sudden expansion of the more brittle inner layer. The varying yield strengths could be obtained, for example, by cold drawing, heat treating, etc. In one embodiment, all layers comprise steel. In other embodiments, the layers comprise other metals, composite materials, etc.

Additionally, the creation of the scallops 18, 42 from multiple different layers prevents cracks from propagating between the layers. For example, when only a single layer is used, a crack will likely result in catastrophic failure, as the crack propagates longitudinally from scallop to scallop. According to the current invention, if the more brittle inner layer(s) begin to crack, these cracks will not propagate into the outer layer, thereby preventing failure. Additionally, creating the scallops 18, 42 from multiple layers eliminates fillets that would be created by machining the scallops, which fillets act as stress concentrations. The scallops 18, 42 also have curved bottom surfaces, which have an improved resistance to bending in comparison to the flat-surfaced scallops that would result from machining. Scallops could be created by making through-holes in any combination of layers, such as only the outer layer or inner layer, both the outer and inner layers, only the layer(s) of high yield strength, only the layer (s) of low yield strength, etc. By creating the scallops 18, 42 from holes formed through an entire layer (or layers), the need to individually machine scallops to specified depths with close tolerances is avoided, thereby reducing manufacturing time and cost.

Advantageously, the increased survivability of perforating guns according to the current invention enables a greater number of shaped charges per foot, or shot density, with respect to prior guns. Additionally or alternatively, the gram load of the explosive for each shaped charge can be increased.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A method of forming a perforating gun, comprising:

positioning a first layer having a first yield strength radially outwardly from a second layer having a second yield strength, a radial gap initially formed between the first and second layers, the first and second yield strengths being dissimilar;

forming a plurality of holes radially through the first or second layers prior to positioning the second layer; and passing a mandrel through an interior portion of the second layer to expand the second layer radially outwardly for engaging the first and second layers together.

2. The method of claim 1, wherein the second yield strength is greater than the first yield strength.

3. The method of claim 1, further comprising positioning a third layer radially inwardly from the second layer and expanding the third layer to engage the second layer.

4. The method of claim 3, further comprising forming a first plurality of holes radially through the first layer and forming a second plurality of holes radially through the third layer prior to expanding the second and third layers, respectively.

5. The method of claim 4, further comprising aligning the first plurality of holes with the second plurality of holes prior to expanding the third layer.

6. The method of claim 1, further comprising: providing a coating between the first layer and the second layer to seal the first layer to the second layer.

7. The method of claim 1, wherein positioning the first layer radially outwardly from the second layer includes positioning a first layer and a second layer formed a metal, a composite material, or combinations of the foregoing.

8. The method of claim 7, wherein positioning the first layer and the second layer includes positioning a first layer comprising steel and a second layer comprising steel.

9. The perforating gun of claim 1, wherein positioning the first layer having the first yield strength radially outwardly from the second layer having the second yield strength includes a second layer having a second yield strength that is greater than the first yield strength.

10. The method of claim 3, wherein positioning the third layer radially inwardly from the second layer includes positioning a third layer having a third yield strength that is less than the second yield strength.

11. The method of claim 10, wherein the first and third yield strengths are each about 130 kpsi and the second yield strength is about 175 kpsi.

* * * * *